US009108413B2

(12) United States Patent
Takeuchi

(10) Patent No.: US 9,108,413 B2
(45) Date of Patent: Aug. 18, 2015

(54) LIQUID DROPLET DISCHARGE DEVICE AND METHOD OF MANUFACTURING LIQUID DROPLET DISCHARGE DEVICE

(71) Applicant: SEIKO EPSON CORPORATION, Tokyo (JP)

(72) Inventor: Junichi Takeuchi, Chino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/864,790

(22) Filed: Apr. 17, 2013

(65) Prior Publication Data

US 2013/0278673 A1 Oct. 24, 2013

(30) Foreign Application Priority Data

Apr. 18, 2012 (JP) ..... 2012-094516

(51) Int. Cl.

| | |
|---|---|
| ***B41J 2/165*** | (2006.01) |
| ***B41J 2/135*** | (2006.01) |
| ***B41J 2/14*** | (2006.01) |
| ***B41J 2/16*** | (2006.01) |

(52) U.S. Cl.

CPC ..... *B41J 2/16535* (2013.01); *B41J 2/1433* (2013.01); *B41J 2/162* (2013.01); *B41J 2/1606* (2013.01); *B41J 2/1628* (2013.01); *B41J 2/1632* (2013.01); *B41J 2/1634* (2013.01); *B41J 2/1642* (2013.01); *B41J 2/164* (2013.01)

(58) Field of Classification Search

USPC ..... 347/33, 45

See application file for complete search history.

(56) References Cited

U.S. PATENT DOCUMENTS

| | | | | |
|---|---|---|---|---|
| 4,368,476 | A * | 1/1983 | Uehara et al. | 347/45 |
| 2002/0196311 | A1* | 12/2002 | Shimomura et al. | 347/45 |
| 2004/0165028 | A1* | 8/2004 | Ito et al. | 347/20 |
| 2004/0174411 | A1* | 9/2004 | Sumiya et al. | 347/47 |
| 2005/0190231 | A1* | 9/2005 | Lim et al. | 347/45 |
| 2006/0033773 | A1* | 2/2006 | Owaki | 347/45 |
| 2010/0253743 | A1 | 10/2010 | Takeuchi | |

FOREIGN PATENT DOCUMENTS

| | | |
|---|---|---|
| JP | 2005-225059 | 8/2005 |
| JP | 2010-240852 | 10/2010 |

* cited by examiner

*Primary Examiner* — Stephen Meier
*Assistant Examiner* — Alexander D Shenderov
(74) *Attorney, Agent, or Firm* — Workman Nydegger

(57) ABSTRACT

In a liquid droplet discharge head, a liquid repellent layer is continuously formed from a liquid droplet discharge surface to a middle position in a thickness direction of an end surface of a nozzle plate.

11 Claims, 13 Drawing Sheets

LIQUID DROPLET DISCHARGE DEVICE AND METHOD OF MANUFACTURING LIQUID DROPLET DISCHARGE DEVICE

BACKGROUND

1. Technical Field

The present invention relates to a liquid droplet discharge device including a wiping member that wipes a liquid droplet discharge surface of a liquid droplet discharge head, and a method of manufacturing the liquid droplet discharge device.

2. Related Art

A liquid droplet discharge device such as an inkjet printer has many advantages in which noise during recording is extremely small, high-speed printing is possible, ink choices vary, cheap plain paper can be used, or the like. For example, as shown in FIG. 15, a liquid droplet discharge head used for such a liquid droplet discharge device has a nozzle plate 1 formed with a plurality of nozzle holes 11 configured to discharge the ink droplet, and a liquid-resistant protective layer 16 and a liquid repellent layer 17 including liquid repellent characteristics with respect to the ink are formed on a liquid droplet discharge surface 1*a* of the nozzle plate 1.

The nozzle plate 1 is formed with the liquid repellent layer 17 on a large substrate, and then is cut into the nozzle plate 1 of a single item size (see, JP-A-2010-240852). For this reason, the liquid-resistant protective layer 16 and the liquid repellent layer 17 are not formed on end surfaces 101 and 102 of the nozzle plate 1.

As shown in FIG. 15, since the liquid repellent layer 17 is not formed on the end surfaces 101 and 102 of the nozzle plate 1, when a wiping member 4 configured to wipe the liquid droplet discharge surface 1*a* of a liquid droplet discharge head 10 is provided in the liquid droplet discharge device, there is a concern that the liquid repellent layer 17 may be peeled off when the wiping member 4 comes into contact with an edge of the liquid repellent layer 17. Thus, there is a need to prevent the wiping member 4 from coming into contact with the edge of the liquid repellent layer 17, by covering end portions 106 and 107 of the nozzle plate 1 with a fixing plate 18 that fixes the liquid droplet discharge head 10 to a head supporter.

However, in order to cover the end portions 106 and 107 of the nozzle plate 1 with the fixing plate 18, since there is a need to increase a size of the nozzle plate 1, there is a problem in that the costs of the nozzle plate 1 increase or the like.

SUMMARY

An advantage of some aspects of the invention is to provide a liquid droplet discharge device capable of preventing the peeling-off of the liquid repellent layer even when the liquid droplet discharge surface is not covered by the fixing plate on the end portion of the nozzle plate, and a method of manufacturing the liquid droplet discharge device.

An aspect of the invention is directed to a liquid droplet discharge device that has a liquid droplet discharge head in which a liquid repellent layer is coated on a liquid droplet discharge surface of a nozzle plate; a fixing plate that fixes the liquid droplet discharge head to a head supporter; and a wiping member that wipes the liquid droplet discharge surface by a relative movement with the liquid droplet discharge head, wherein the liquid repellent layer is continuously coated to an end surface of the nozzle plate over a boundary between the liquid droplet discharge surface and the end surface, and the fixing plate does not overlap the liquid droplet discharge surface and fixes the liquid droplet discharge head to the head supporter, at least on an end portion of the nozzle plate located on an initial point side of wiping using the wiping member.

In this configuration, the liquid repellent layer is continuously formed from the liquid droplet discharge surface to a middle position in a thickness direction of the end surface of the nozzle plate. For this reason, when the wiping member comes into contact with the nozzle plate, the wiping member does not come into contact with the edge of the liquid repellent layer. Therefore, even in the end portion of the nozzle plate located on the initial point side of wiping using the wiping member, since there is no need for a structure in which the liquid droplet discharge surface of the nozzle plate overlaps the fixing plate, the size of the nozzle plate can be reduced. Thus, the costs of the nozzle plate can be reduced.

The liquid droplet discharge device of the aspect of the invention may be configured such that, on the end surface, a boundary between a portion coated with the liquid repellent layer and a non-coated portion is closer to the liquid droplet discharge surface than a back surface of the liquid droplet discharge surface, wherein the liquid droplet discharge surface is defined as a front surface of a nozzle plate and the back surface of the liquid droplet discharge surface is defined as a back surface of the nozzle plate. In this configuration, the liquid repellent layer is continuously formed across the liquid droplet discharge surface to the coated portion of the end surface. It is possible to realize a configuration in which the liquid repellent layer is continuously formed from the liquid droplet discharge surface to the boundary between the portion of the end surface coated with the liquid repellent layer and the non-coated portion.

The liquid droplet discharge device of the aspect of the invention may be configured such that the end surface includes a first end surface connected to the back surface of the liquid droplet discharge surface, and a second end surface connected to the first end surface and parallel to the liquid droplet discharge surface, and the liquid repellent layer is continuously coated from the liquid droplet discharge surface to the second end surface. In this configuration, by forming the liquid repellent layer from the side of the liquid droplet discharge surface, it is possible to reliably realize a configuration in which the liquid repellent layer is continuously formed from the liquid droplet discharge surface to the middle position in the thickness direction of the end surface of the nozzle plate.

The liquid droplet discharge device of the aspect of the invention may be configured such that, for example, the second end surface extends along a surface parallel to the liquid droplet discharge surface, and the end surface includes a third end surface that is connected to the liquid droplet discharge surface and the second end surface between the liquid droplet discharge surface and the second end surface.

The liquid droplet discharge device of the aspect of the invention may be configured such that the second end surface includes an inclined surface that is inclined with respect to both the liquid droplet discharge surface and the first end surface.

The liquid droplet discharge device of the aspect of the invention may be configured such that the second end surface includes a concave-shaped curved surface.

Another aspect of the invention is directed to a method suitable for manufacturing the liquid droplet discharge device and having the following configuration. That is, the method of manufacturing the liquid droplet discharge device that has a liquid droplet discharge head in which a liquid repellent layer is coated on a liquid droplet discharge surface of a nozzle plate, a fixing plate that fixes the liquid droplet discharge head to a head supporter, and a wiping member that wipes the liquid droplet discharge surface by a relative movement with the liquid droplet discharge head, the method includes forming nozzle holes on the substrate; forming a plurality of grooves on one main surface of the substrate; coating the liquid repellent layer on the main surface; and cutting the substrate along the plurality of grooves to obtain individual pieces of a plurality of nozzle plates.

In the aspect of the invention, after the grooves are formed along a region in which the nozzle plates are cut with respect to one surface of the substrate, the liquid repellent layer is formed on the one surface of the substrate, then, the substrate is cut along the grooves to obtain the nozzle plates. For this reason, it is possible to easily realize a configuration in which the liquid repellent layer is continuously formed from the liquid droplet discharge surface to the middle position in the thickness direction of the end surface of the nozzle plate.

According to the aspect of the invention, in the forming of the nozzle holes and in the forming of the grooves, it is preferable that the nozzle holes and the grooves be concurrently formed on the substrate. In this configuration, the number of process can be reduced.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 15:
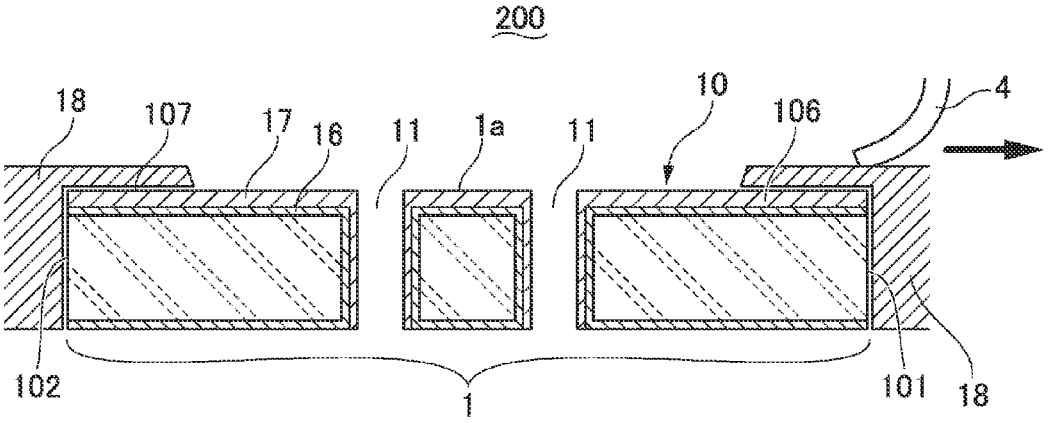
FIG. 15 is an explanatory view of the liquid droplet discharge head related to a reference example of the invention.

Embodiments of the invention will be described referring to the drawings. In addition, in the following description, as a liquid droplet discharge device to which the invention is applied, an ink jet printer will be described as an example. Furthermore, in the following description, in order to easily understand the correspondence to the configuration described referring to FIG. 15, the corresponding portions will be described by being denoted the same reference numerals. Furthermore, in the following description, a main scanning direction (a direction perpendicular to a row direction of the nozzle holes) is set to an X direction, and an auxiliary scanning direction (the row direction of the nozzle holes) is set to a Y direction.

Embodiment 1

Overall Configuration of Liquid Droplet Discharge Device

Figure 1:
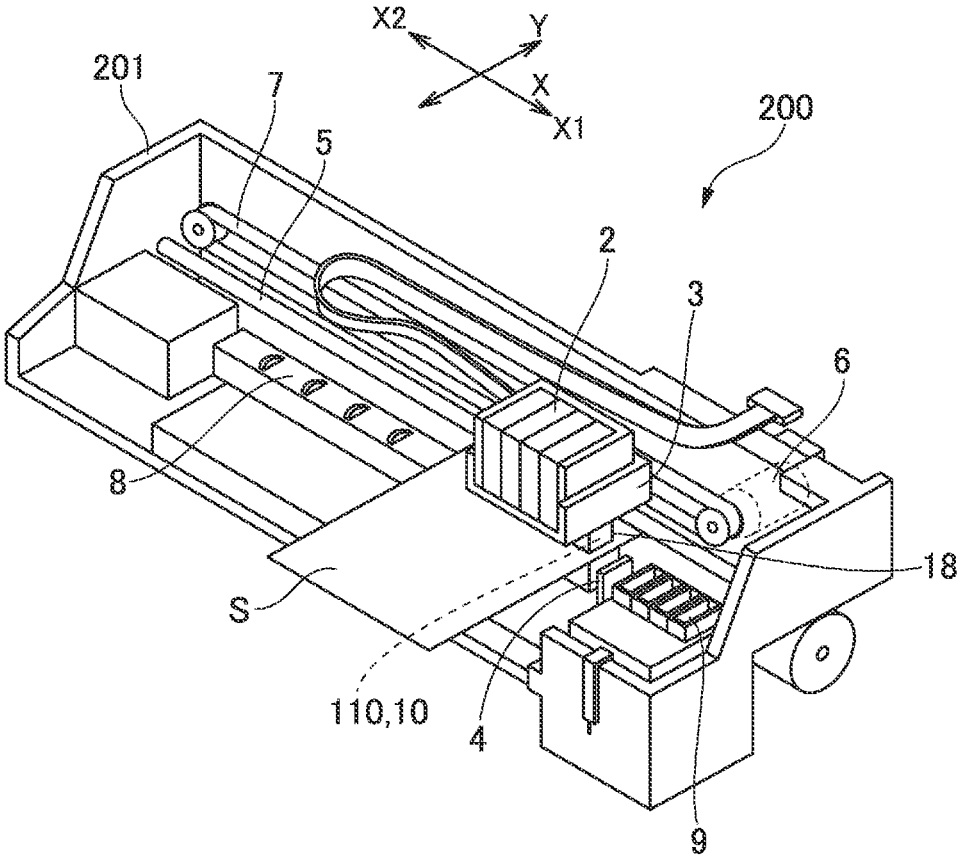
FIG. 1 is an explanatory view of a liquid droplet discharge device related to Embodiment 1 of the invention.

FIG. 1 an explanatory view of the liquid droplet discharge device related to Embodiment 1 of the invention. In FIG. 1, a liquid droplet discharge device 200 of the present embodiment is an ink jet printer that discharges liquid ink to a surface of a recoding medium S such as recording paper to record images or the like. The liquid droplet discharge device 200 includes a head assembly 110 including a plurality of liquid droplet discharge heads 10, a carriage 3 to which the head assembly 110 is attached, a carriage shaft 5 that supports the carriage 3 so as to be movable in the main scanning direction X, a platen 8 that transports the recording medium S in the auxiliary scanning direction Y or the like. The ink is stored in an ink cartridge 2, and the ink cartridge 2 and the head assembly 110 are mounted on the carriage 3. In addition, it is also possible to adopt a configuration in which the ink cartridge 2 is placed on a main body 201 side of the liquid droplet discharge device 200, and the ink is supplied to the liquid droplet discharge head 10 from the ink cartridge 2 through an ink supply tube. The carriage 3 is connected to a timing belt 7, and the timing belt 7 is driven by a pulse motor 6 such as a DC motor. Thus, when the pulse motor 6 is operated, the carriage 3 is guided to the carriage shaft 5, and moves back and forth in the main scanning direction X (the width direction of the recording medium S).

Herein, at a position corresponding to a home position of the carriage 3, that is, near one end portion of the carriage shaft 5, a cap member 9 is provided which seals the liquid droplet discharge surface of the liquid droplet discharge head 10. A suction unit (not shown) configured to suck the inside of the cap member is connected to the cap member 9. In the present embodiment, a plurality of cap members 9 is provided in response to the number of the liquid droplet discharge heads 10. The cap member 9 seals the liquid droplet discharge surface of the liquid droplet discharge head 10, thereby to prevent the ink from drying near the nozzle holes of the liquid droplet discharge head 10. Furthermore, the cap member 9 functions as an ink receiver when performing the flushing operation of ejecting the ink droplet from the nozzle holes or the suction operation of sucking the inside of the cap member 9 using the suction unit at a predetermined timing to forcibly discharge the ink or the like from the nozzle holes.

Furthermore, in the present embodiment, the wiping member 4 is provided which is constituted by a cleaning blade or the like that wipes the liquid droplet discharge surface of the liquid droplet discharge head 10, in adjacent to the cap member 9. Thus, when bringing the leading end portion of the wiping member 4 into slide-contact with the liquid droplet discharge surface of the liquid droplet discharge head 10, by moving the carriage 3 at the predetermined timing, it is possible to carry out the cleaning operation of wiping the liquid droplet discharge surface.

Configuration of Liquid Droplet Discharge Head 10

Figure 2A:
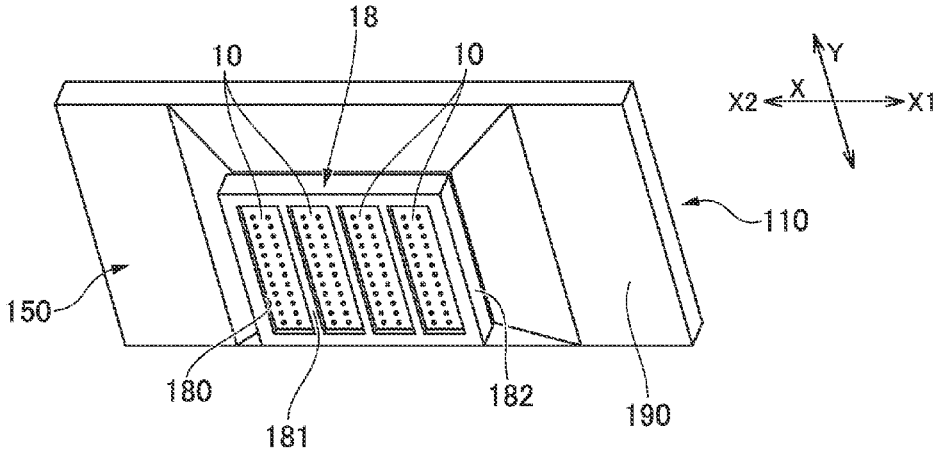
FIGS. 2A and 2B are explanatory views of a head assembly used for the liquid droplet discharge device related to Embodiment 1 of the invention.
Figure 2B:
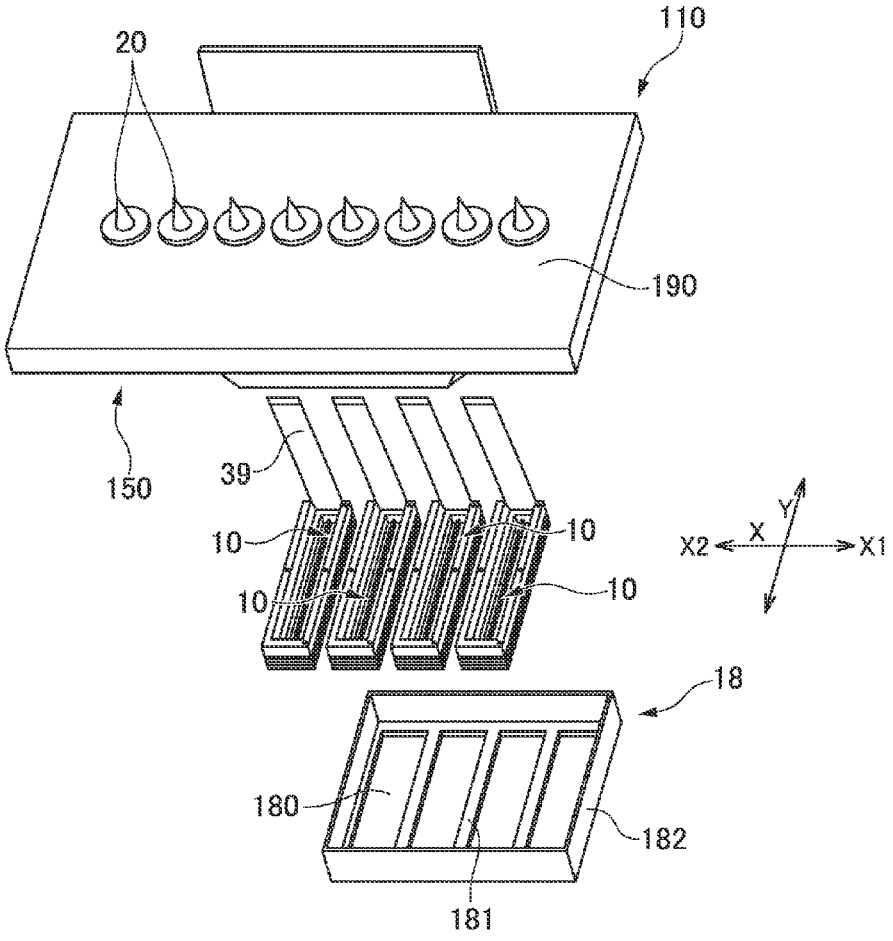
Figure 3:
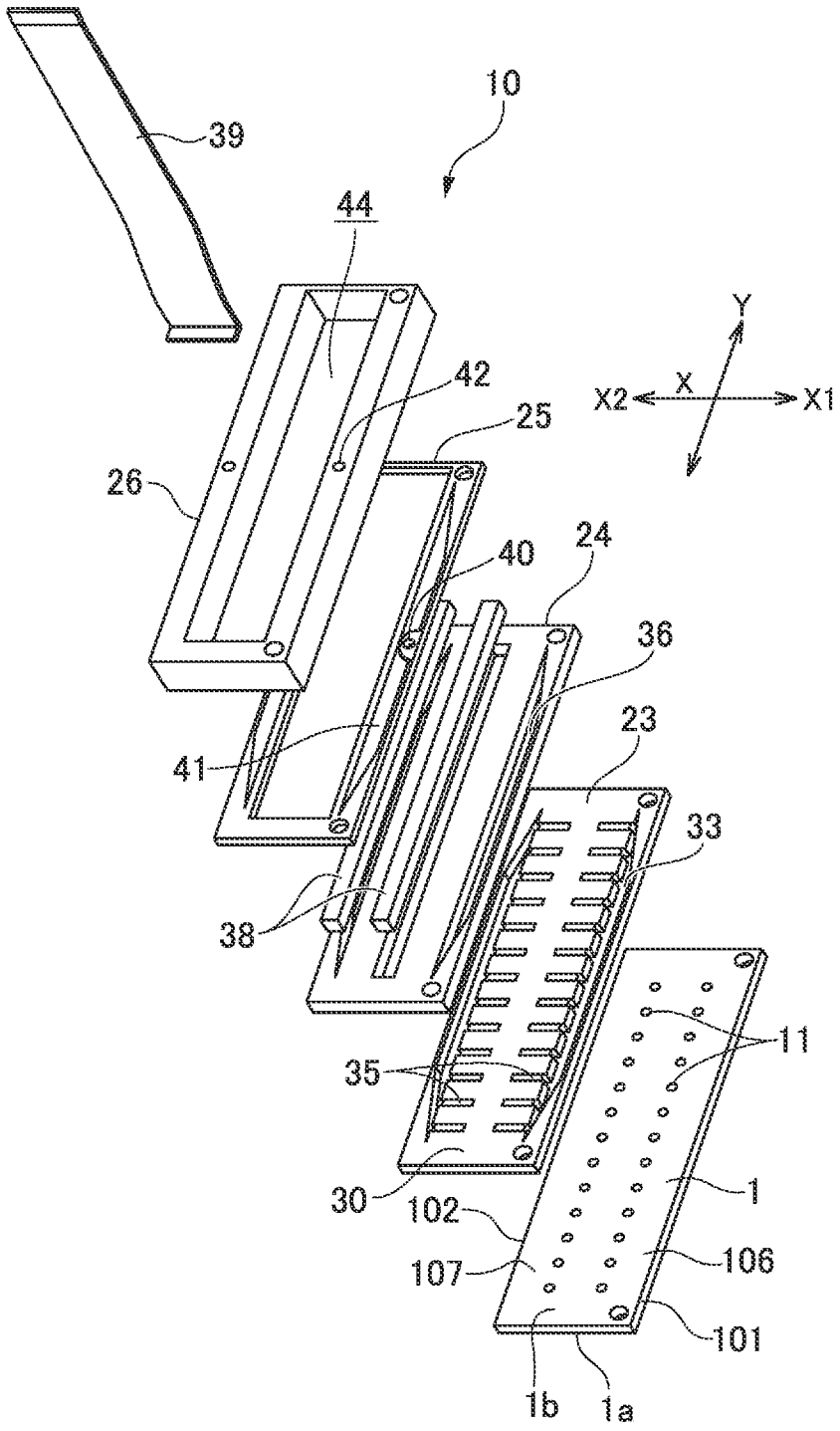
FIG. 3 is an exploded perspective view of a liquid droplet discharge head used for the liquid droplet discharge device related to Embodiment 1 of the invention.
Figure 4:
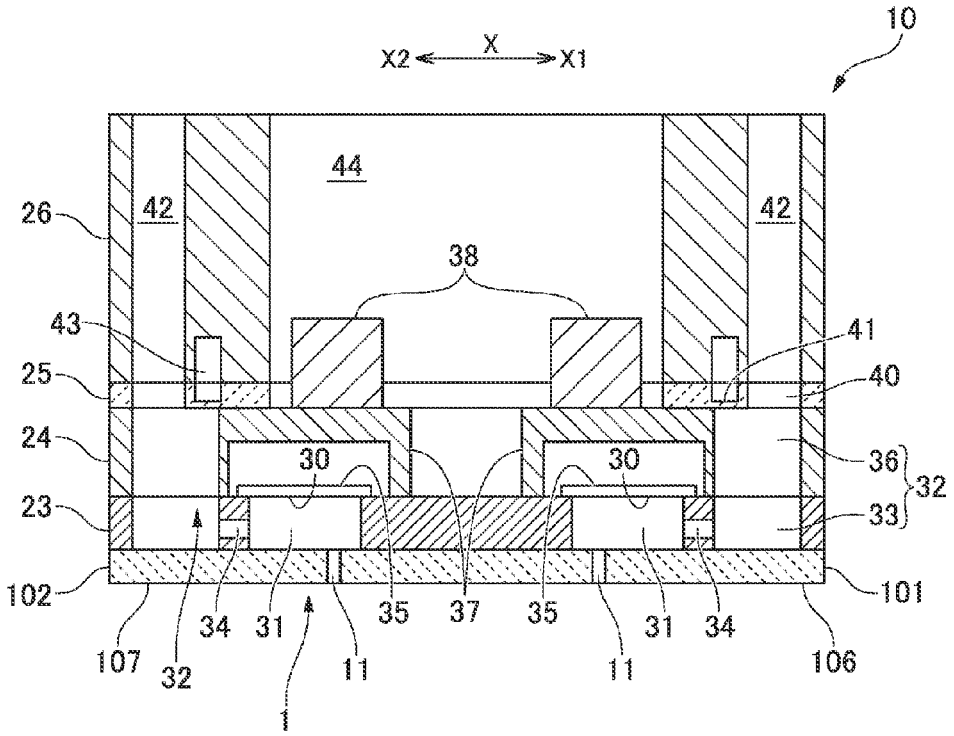
FIG. 4 is a cross-sectional view of the liquid droplet discharge head used for the liquid droplet discharge device related to Embodiment 1 of the invention.

FIGS. 2A and 2B are explanatory views of the head assembly 110 used for the liquid droplet discharge device 200 related to Embodiment 1 of the invention, FIG. 2A is a perspective view of the head assembly 110, and FIG. 2B is an exploded perspective view of the head assembly 110. FIG. 3 is an exploded perspective view of the liquid droplet discharge head 10 used for the liquid droplet discharge device 200 related to Embodiment 1 of the invention. FIG. 4 is a cross-sectional view of the liquid droplet discharge head 10 used for the liquid droplet discharge device 200 related to Embodiment 1 of the invention.

As shown in FIGS. 2A and 2B, in the liquid droplet discharge device 200 of the present embodiment, the plurality of liquid droplet discharge heads 10 is mounted on the carriage 3 as the head assembly 110. The head assembly 110 is generally constituted by a case 150 as a head supporter, a plurality of liquid droplet discharge heads 10, and a fixing plate 18. The case 150 is a box-like member that accommodates the liquid droplet discharge heads 10 therein, and a needle holder 190 is formed on an upper surface side thereof. The needle holder 190 is a plate-like member for attaching an ink introduction needle 20, and in the present embodiment, eight ink introduction needles 20 are uniformly disposed on the needle holder 190 in response to the ink color of the ink cartridge 2. The ink introduction needle 20 is a hollow needle-like member inserted into the ink cartridge 2, and is configured to introduce the ink stored in the ink cartridge 2 from an introduction hole (not shown) provided in the leading end portion into the liquid droplet discharge head 10 through a convergence flow path in the case 150.

On the bottom surface side of the case 150, four liquid droplet discharge heads 10 are placed in the state of being uniformly positioned in the main scanning direction X, and each of the four liquid droplet discharge heads 10 is directed to a long side in the main scanning direction X. Each of the four liquid droplet discharge heads 10 is fixed to the case 150 using the metallic fixing plate 18. The fixing plate 18 has a bottom plate portion 181 formed with four opening portions 180 at positions corresponding to the liquid droplet discharge heads 10, and a side plate portion 182 that is bent at a right angle from an outer edge of the bottom plate portion 181, and the liquid droplet discharge heads 10 and the side plate portion 182 are fixed to each other by an adhesive or the like.

As shown in FIGS. 3 and 4, the liquid droplet discharge head 10 is generally constituted from the nozzle plate 1, a flow path substrate 23, a common liquid chamber substrate 24, and a compliance substrate 25, and is attached to a unit case 26 in the state of stacking these members.

The nozzle plate 1 is constituted by a silicon single crystalline substrate in which the plurality of nozzle holes 11 is arranged in the auxiliary scanning direction Y at a pitch corresponding to the dot formation concentration, and a liquid droplet discharge surface 1*a* is formed by the one surface thereof. In the present embodiment, two rows of the nozzle rows are formed by providing 180 nozzle holes 11 in rows at a pitch of 180 dpi. Herein, the nozzle plate 1 is a rectangular plate material, and a long side thereof is directed in the main scanning direction X. Thus, the nozzle holes 11 are arranged in the auxiliary scanning direction Y to form the nozzle row, and the nozzle rows are arranged in parallel in the main scanning direction X. In the present embodiment, the thickness of the nozzle plate 1 is, for example, substantially 65 μm.

The flow path substrate 23 is manufactured by the silicon single crystalline substrate, like the nozzle plate 1. On the upper surface (the surface of the common liquid chamber substrate 24 side) of the flow path substrate 23, a thin elastic film 30 formed of silicon dioxide is formed by the thermal oxidation. In such a flow path substrate 23, a plurality of pressure chambers 31 partitioned by a plurality of partitions is formed in response to each nozzle hole 11, by anisotropic etching processing. On the outer side of the row of the pressure chamber 31 in the flow path substrate 23, a communication space portion 33 is formed which partitions a part of the common liquid chamber 32 as a chamber into which the common ink of each pressure chamber 31 is introduced. The communication space portion 33 communicates with each pressure chamber 31 via the ink supply path 34.

On the elastic film 30 of the upper surface (the surface of an opposite side to the nozzle plate 1 side) of the flow path substrate 23, a piezoelectric element 35 is provided for each of the pressure chambers 31, and such a piezoelectric element 35 has a structure in which a metallic lower electrode film, a piezoelectric layer formed of lead zirconate titanate (PZT) or the like, and an upper electrode film made of a metal are sequentially stacked. The piezoelectric element 35 is a piezoelectric vibrator of a so-called bending mode, and is formed so as to cover the upper portion of the pressure chamber 31.

On the flow path substrate 23 formed with the piezoelectric element 35, the common liquid chamber substrate 24 having a penetrated space portion 36 penetrating in the thickness direction is placed. The common liquid chamber substrate 24 is manufactured by the use of the silicon single crystalline substrate, like the flow path substrate 23 and the nozzle plate 1. The penetrated space portion 36 in the common liquid chamber substrate 24 communicates with the communicated space portion 33 of the flow path substrate 23 to partition a part of the common liquid chamber 32. On the upper surface (the surface of an opposite side to the flow path substrate 23) of the common liquid chamber substrate 24, a drive IC 38 for driving each piezoelectric element 35 is provided. Each terminal of the drive IC 38 is connected to an extraction wiring extracted from the individual electrodes of each piezoelectric element 35 via a bonding wire (not shown) or the like. Moreover, each terminal of the drive IC 38 is electrically connected to a control unit (not shown) of the liquid droplet discharge device 200 via an external wiring 39 such as a flexible print cable (FPC), and various signals such as the print signal from the control unit side are supplied via the external wiring 39.

On the upper surface side of the common liquid chamber substrate 24, the compliance substrate 25 is placed. In a region, in the compliance substrate 25, facing the penetrated space portion 36 of the common liquid chamber substrate 24, an ink introduction port 40 for supplying the ink from the ink introduction needle 20 side to the common liquid chamber 32 is formed so as to penetrate in the thickness direction. Furthermore, a region other than the ink introduction port 40 of the region facing the penetrated space portion 36 of the compliance substrate 25 is a flexible portion 41 formed extremely thinly, and the upper opening of facing the penetrated space portion 36 is sealed by the flexible portion 41, whereby the common liquid chamber 32 is partitioned and formed. Such a flexible portion 41 functions as a compliance portion that absorbs the pressure fluctuation of the ink in the common liquid chamber 32.

The unit case 26 is a member in which an ink introduction path 42 for supplying the ink introduced from the ink introduction needle 20 side (see FIG. 2B) to the common liquid chamber 32 side in communication with the ink introduction port 40 is formed, and a concave portion 43 adapted to permit the expansion of the flexible portion 41 is formed in a region facing the flexible portion 41. In the central portion of the unit case 26, specifically, in a region facing the drive IC 38 provided on the common liquid chamber substrate 24, a space portion 44 penetrating in the thickness direction is opened, and the external wiring 39 is inserted through the space portion 44 and is connected to the drive IC 38.

The nozzle plate 1, the flow path substrate 23, the common liquid chamber substrate 24, the compliance substrate 25, and the unit case 26 are joined to one another, by placing an adhesive, a thermal welding film or the like therebetween and being heated in the stacked state, thereby to constitute the liquid droplet discharge head 10.

The liquid droplet discharge head 10 configured in this manner is attached to the carriage 3 so that the row direction of the nozzle holes 11 is matched with the auxiliary scanning direction Y in the state of the head assembly 110. Moreover, each liquid droplet discharge head 10 takes the ink from the ink cartridge 2 to the common liquid chamber 32 side via the ink introduction path 42 and the ink introduction port 40, and fills the ink flow path (a kind of the liquid flow path) from the common liquid chamber 32 to the nozzle hole 11 with the ink. Moreover, by supplying the drive signal from the drive IC 38 to the piezoelectric element 35 and performing the bending deformation of the piezoelectric element 35, the pressure fluctuation is caused in the ink in the corresponding pressure chamber 31, and the liquid droplet of the ink is discharged from the nozzle hole 11 by the use of the pressure fluctuation of the ink.

Configuration of Nozzle Plate 1 and Periphery Thereof

Figure 5:
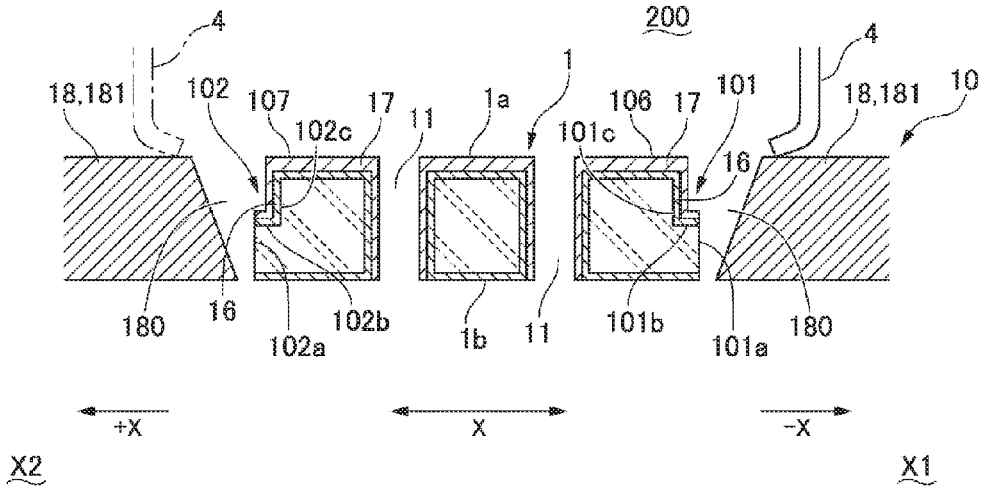
FIG. 5 is an enlarged cross-sectional view that shows an aspect in which a nozzle plate of the liquid droplet discharge head of the liquid droplet discharge device related to Embodiment 1 of the invention and a periphery thereof are cut in a main scanning direction.

FIG. 5 is an enlarged cross-sectional view that shows an aspect in which the nozzle plate 1 of the liquid droplet discharge head 10 of the liquid droplet discharge device 200 related to Embodiment 1 of the invention and the periphery thereof are cut in the main scanning direction X. In addition, in FIG. 5, in both surfaces of the nozzle plate 1, the liquid droplet discharge surface 1*a* is shown upward.

As shown in FIG. 5, in the liquid droplet discharge head 10 of the liquid droplet discharge device 200 of the present embodiment, on the liquid droplet discharge surface 1*a* of the nozzle plate 1 and the back surface 1*b* of the opposite side thereof of the nozzle plate 1, a liquid-resistant protective layer 16 formed of a silicon oxidation film or the like is formed, and the liquid-resistant protective layer 16 is also formed on the inner surface of the nozzle holes 11. Furthermore, the nozzle plate 1 is formed with the liquid repellent layer 17 containing fluorine on the liquid droplet discharge surface 1*a*, and the liquid repellent layer 17 is also formed on the inner surface of the nozzle hole 11. Such a liquid repellent layer 17 takes a function of easily removing the dirt or the like due to the ink, at the time of the cleaning operation using the wiping member 4.

In such a liquid droplet discharge head 10, as shown by an arrow −X, when the carriage 3 moves to the home position, the wiping member 4 slides on the liquid droplet discharge surface 1*a* of the liquid droplet discharge head 10 from one side X1 to the other side X2, thereby to remove the dirt from the ink. At that time, the end portion 107 of the one side X1 in which the end surface 102 is located in the nozzle plate 1 becomes an initial point of wiping. In contrast, as shown by an arrow +X, when the carriage 3 moves from the home position, as shown by an alternate long and short dash line, the wiping member 4 slides on the liquid droplet discharge surface 1*a* of the liquid droplet discharge head 10 from one side X1 to the other side X2. At that time, the end portion 107 of the other side X2 in which the end surface 102 is located in the nozzle plate 1 becomes an initial point of wiping.

When performing such a cleaning operation, in the present embodiment, in the nozzle plate 1, all the four end surfaces including the end surfaces 101 and 102 have the configuration described below so that the liquid repellent layer 17 is not peeled off from the edge by the contact with the wiping member 4. In addition, since all the four end surfaces of the nozzle plate 1 have the same configuration, in the following description, the configurations of the end surfaces 101 and 102 will be described, and the description of other end surfaces will be omitted.

First, a step portion facing the liquid droplet discharge side is formed on the end surface 101 of the nozzle plate 1, and as a result, a first end surface 101*a* connected to the back surface 1*b* of an opposite side to the liquid droplet discharge surface 1*a* is at a right angle, and a second end surface 101*b* facing the liquid droplet discharge side between the first end surface 101*a* and the liquid droplet discharge surface 1*a* on the inner side of the first end surface 101*a* are formed on the end surface 101. Herein, the second end surface 101*b* is formed to be parallel to the liquid droplet discharge surface 1*a*, and a third end surface 101*c* perpendicular with respect to the liquid droplet discharge surface 1*a*, the second end surface 101*b* and the back surface 1*b* is formed between the liquid droplet discharge surface 1*a* and the second end surface 101*b*. Furthermore, on the second end surface 101*b* and the third end surface 101*c*, the liquid-resistant protective layer 16 and the liquid repellent layer 17 are continuously formed over the boundary between the liquid droplet discharge surface 1*a* and the end surface 101 from the liquid droplet discharge surface 1*a*, and thus, the liquid-resistant protective layer 16 and the liquid repellent layer 17 are formed in the corner portions of the liquid droplet discharge surface 1*a* and the third end surface 101*c*. In contrast, since the liquid-resistant protective layer 16 and the liquid repellent layer 17 are not formed on the back surface 1*b* and the first end surface 101*a*, the liquid-resistant protective layer 16 and the liquid repellent layer 17 are not formed in the corner portions of the back surface 1*b* and the first end surface 101*a*. Thus, the liquid-resistant protective layer 16 and the liquid repellent layer 17 are continuously formed from the liquid droplet discharge surface 1*a* to the middle position of the end surface 101 in the thickness direction. In the present embodiment, the boundary between the portion coated with the liquid repellent layer 17 and the non-coated portion in the end surface 101 is an approximately intermediate position between the back surface 1*b* of the liquid droplet discharge surface 1*a* and the liquid droplet discharge surface 1*a*. However, in the end surface 101, it is preferable that the boundary between the portion coated with the liquid repellent layer 17 and the non-coated portion be located at a position that is closer to the liquid droplet discharge surface 1*a* than the back surface 1*b* of the liquid droplet discharge surface 1*a*. According to such a configuration, there is an advantage that a groove 12 described below may be shallowly formed.

Furthermore, like the end surface 101, the step portion facing the liquid droplet discharge side is also formed on the end surface 102 of the nozzle plate 1. As a result, a first end surface 102*a* connected to the back surface 1*b* of an opposite side to the liquid droplet discharge surface 1*a* at a right angle, and a second end surface 102*b* facing the liquid droplet discharge side between the first end surface 102*a* and the liquid droplet discharge surface 1*a* on the inner side of the first end surface 102*a* are formed on the end surface 102. Herein, the second end surface 102*b* is formed to be parallel to the liquid droplet discharge surface 1*a*, and a third end surface 102*c* perpendicular with respect to the liquid droplet discharge surface 1*a*, the second end surface 102*b*, and the back surface 1*b* is formed between the liquid droplet discharge surface 1*a* and the second end surface 102*b*. Furthermore, on the second end surface 102*b* and the third end surface 102*c*, the liquid-resistant protective layer 16 and the liquid repellent layer 17 are continuously formed from the liquid droplet discharge surface 1*a*, and thus, the liquid-resistant protective layer 16 and the liquid repellent layer 17 are formed in the corner portions of the liquid droplet discharge surface 1*a* and the third end surface 102*c*. In contrast, since the liquid-resistant protective layer 16 and the liquid repellent layer 17 are not formed on the back surface 1*b* and the first end surface 102*a*, the liquid-resistant protective layer 16 and the liquid repellent layer 17 are not formed in the corner portions of the back surface 1*b* and the first end surface 102*a*. Thus, the liquid-resistant protective layer 16 and the liquid repellent layer 17 are continuously formed from the liquid droplet discharge surface 1*a* to the middle position of the end surface 102 in the thickness direction.

Furthermore, in the present embodiment, the bottom surface portion 181 of the fixing plate 18 does not overlap the liquid droplet discharge surface 1*a* (the liquid droplet discharge surface 1*a* of the liquid droplet discharge head 10) of the nozzle plate 1 in the end portions 106 ad 107 in which the end surfaces 101 and 102 are located. In addition, in the present embodiment, since the liquid droplet discharge head 10 and the side plate portion 182 of the fixing plate 18 are fixed to each other by an adhesive or the like, the bottom plate portion 181 of the fixing plate 18 does not overlap the liquid droplet discharge surface 1*a* in any end portion of the nozzle plate 1, and fixes the liquid droplet discharge head 10 to the case 150.

Main Effect of the Present Embodiment

As described above, in the liquid droplet discharge head 10 of the present embodiment, the liquid repellent layer 17 is continuously formed from the liquid droplet discharge surface 1*a* to the middle position in the thickness direction of the end surfaces 101 and 102 of the nozzle plate 1. For this reason, when the wiping member 4 comes into contact with the nozzle plate 1, the wiping member 4 does not come into contact with the edge of the liquid repellent layer 17. Therefore, even in the end portions 106 and 107 of the nozzle plate 1 located on the initial point side of wiping using the wiping member 4, since there is no need for a structure in which the liquid droplet discharge surface 1*a* of the nozzle plate 1 overlaps the fixing plate 18, the size of the nozzle plate 1 can be reduced. Therefore, the costs of the nozzle plate 1 can be reduced.

Method of Manufacturing the Liquid Droplet Discharge Head 10

Figure 6:
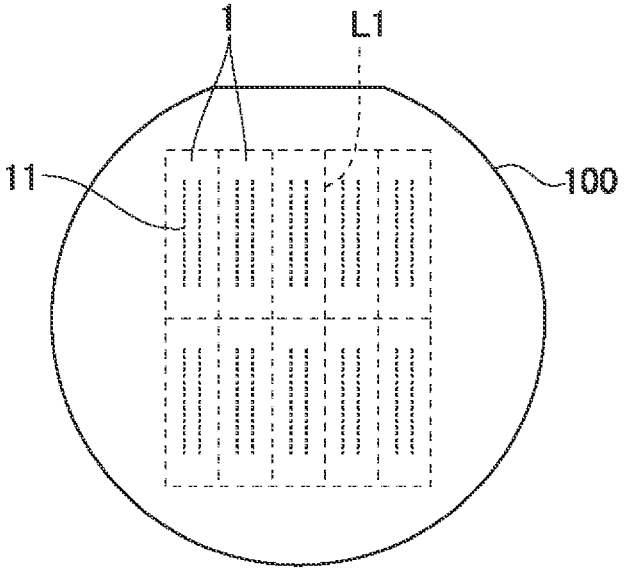
FIG. 6 is a plan view of a substrate used for manufacturing the nozzle plate shown in FIG. 5.

An example of a method of manufacturing the liquid droplet discharge head 10 shown in FIG. 1 will be described referring to FIGS. 6 to 8H. FIG. 6 is a plan view of the substrate 100 used for manufacturing the nozzle plate 1 shown in FIG. 5. FIGS. 7A to 7E are process cross-sectional views that show a method of manufacturing the nozzle plate 1 shown in FIG. 5. FIGS. 8F to 8H are process cross-sectional views that show the method of manufacturing the nozzle plate 1 performed subsequent to FIGS. 7A to 7E. In addition, in FIGS. 7A to 8H, in the two main surfaces (the first surface 100*a* and the second surface 100*b*) of the substrate 100, the main surface (the first surface 100*a*) serving as the liquid droplet discharge surface 1*a* when forming the nozzle plate 1 is shown upward.

In order to manufacture the nozzle plate 1 of the liquid droplet discharge head 10 shown in FIG. 1, first, the substrate 100 shown in FIG. 6 is prepared. For example, the substrate 100 is a silicon substrate having a thickness of 280 μm, and is a large silicon substrate that is able to take a plurality of nozzle plates 1. Thus, in the present embodiment, each process described below is performed, the nozzle hole 11 or the like is formed in each of the plurality of regions surrounded by a dicing line shown by an alternate long and short dash line L1, and then the substrate 100 is cut along the dicing line, thereby to manufacture the plurality of nozzle plates 1.

Figure 7A:
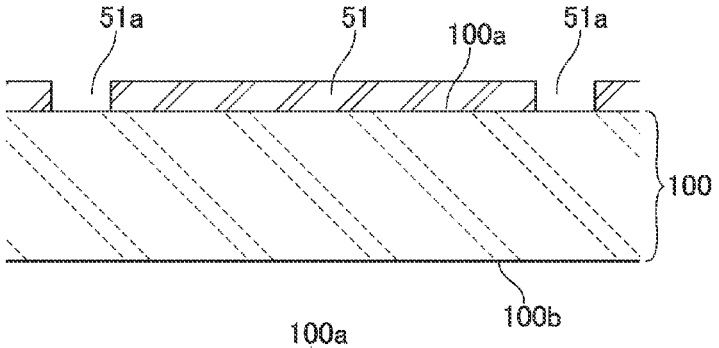
FIGS. 7A to 7E are process cross-sectional views that show a method of manufacturing the nozzle plate shown in FIG. 5.
Figure 7B:
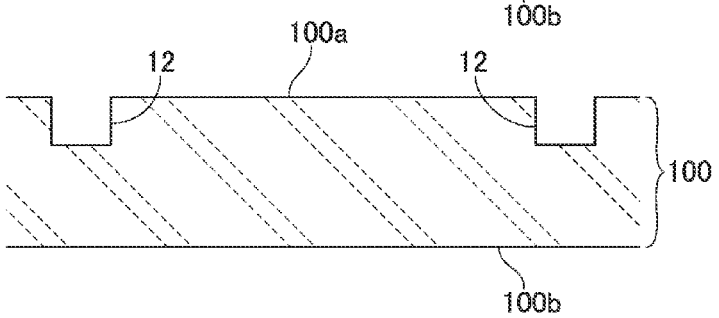
Figure 8F:
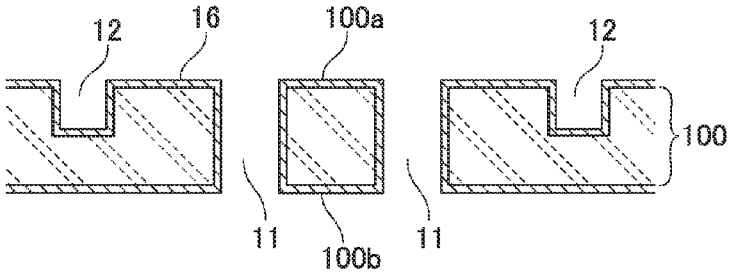
FIGS. 8F to 8H are process cross-sectional views that show the method of manufacturing the nozzle plate performed subsequent to FIGS. 7A to 7E.
Figure 8G:
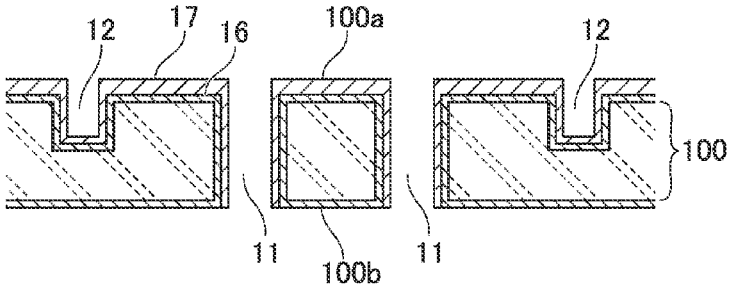
Figure 8H:
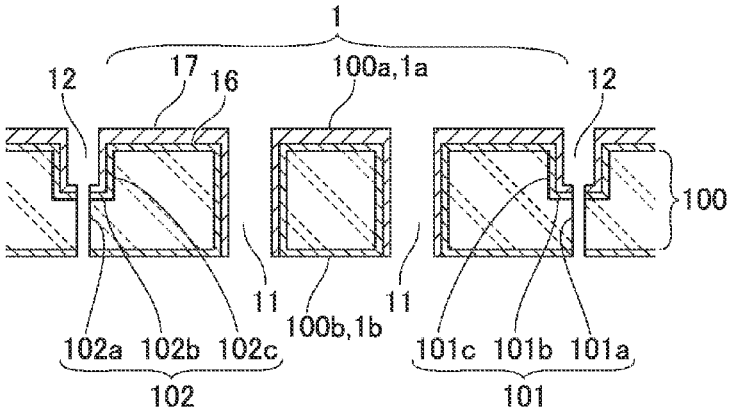

In the present embodiment, first, in the process of forming the grooves shown in FIGS. 7A and 7B, the grooves 12 are formed along the region in which the nozzle plate 1 is cut with respect to the first surface 100*a* of the substrate 100. More specifically, as shown in FIG. 7A, an etching mask 51 formed of a resist mask is formed on the first surface 100*a* of the substrate 100, using the photolithography technique. Next, the first surface 100*a* of the substrate 100 is etched via an aperture portions 51*a* of the etching mask 51, as shown in FIG. 7B, after forming the grooves 12, the etching mask 51 is removed by the sulfuric acid treatment or the like. As such etching, in the present embodiment, the first surface 100*a* of the substrate 100 is subjected to the anisotropic dry etching using an ICP dry etching device (not shown), and the grooves 12 are formed perpendicularly to the first surface 100*a*. As the etching as of this case, $C_4F_8$ gas and $SF_6$ gas are used, and such etching gases are alternately used. Herein, the $C_4F_8$ gas is used so as to protect the side surface so that etching does not proceed to the side surfaces of the grooves 12, and the $SF_6$ gas is used so as to promote etching of the substrate 100 in the vertical direction.

Figure 7C:
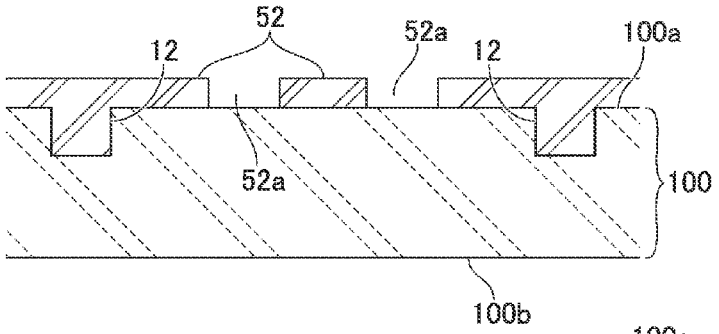
Figure 7D:
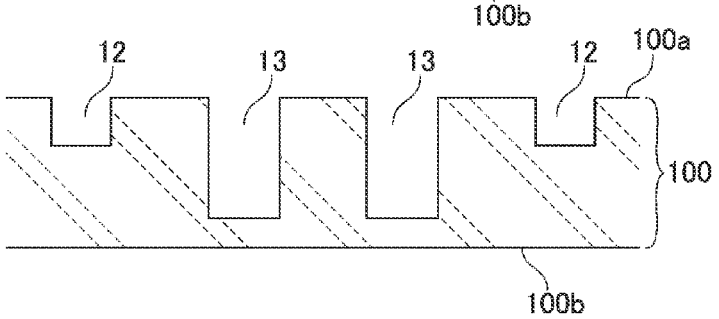

Next, in the process of forming the nozzle holes shown in FIGS. 7C and 7D, the concave portions 13 are formed on the first surface 100*a* of the substrate 100 at the positions corresponding to the nozzle holes 11. More specifically, as shown in FIG. 7C, the etching mask 52 formed of the resist mask is formed on the first surface 100*a* of the substrate 100, using the photolithography technique. Next, the first surface 100*a* of the substrate 100 is etched via an aperture portions 52*a* of the etching mask 52, the concave portions 13 are formed, and then, the etching mask 52 is removed by the sulfuric acid treatment or the like. As such etching, in the present embodiment, the first surface 100*a* of the substrate 100 is subjected to the anisotropic dry etching using an ICP dry etching device (not shown), and the concave portions 13 are formed perpendicularly to the first surface 100*a*. As the etching gas of this case, $C_4F_8$ gas and $SF_6$ gas are used, and such etching gases are alternately used. Herein, the $C_1F_8$ gas is used so as to protect the side surface so that etching does not proceed to the side surfaces of the concave portions 13, and the $SF_6$ gas is used so as to promote etching of the substrate 100 in the vertical direction.

Figure 7E:
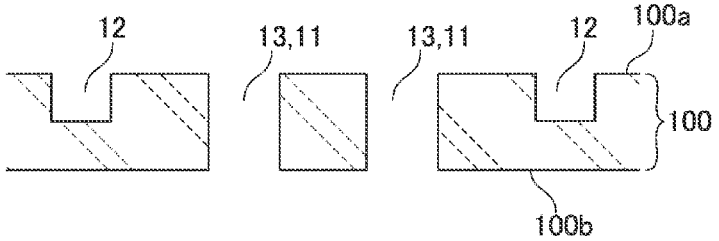

Next, in the process of forming the thin plate shown in FIG. 7E, the substrate 100 is thinned, for example, up to approximately 65 μm from the second surface 100*b* of the substrate 100, and the nozzle holes 11 are formed through the concave portions 13. When performing the process of forming the thin plate, in the present embodiment, after performing the grinding work or the polishing work on the second surface 100*b* side of the substrate 100, cleaning is performed. For example, the second surface 100*b* of the substrate 100 is subjected to the grinding work using a back grinder (not shown). In addition, in the process of forming the thin plate, the second surface 100*b* may be polished by a polisher and a CMP device to thin the substrate 100. Furthermore, the substrate 100 may be thinned by etching.

Next, in the process of forming the liquid-resistant protective layer shown in FIG. 8F, the liquid-resistant protective layer 16 having ink-resistant properties is formed on the entire surface of the substrate 100 including the inner wall of the nozzle holes 11. In the present embodiment, the substrate 100 is input to a thermal oxidation furnace, and a thermal oxidation film ($SiO_2$ film), for example, having a film thickness of 0.1 μm is formed on the entire surface of the substrate 100 as the liquid-resistant protective layer 16.

Next, the liquid repellent treatment for allowing the substrate 100 to have the liquid repellent properties with respect to the ink is performed. Specifically, in the liquid repellent layer coating process shown in FIG. 8G, the liquid repellent material including a silicon compound containing fluorine atoms as a main ingredient is formed on the first surface 100*a* of the substrate 100 by the method such as a vapor deposition, and the liquid repellent layer 17 is formed on the entire first surface 100*a* of the substrate 100. At this time, the liquid repellent layer 17 is also formed on the inner walls of the nozzle holes 11 and the grooves 12. In addition, as the liquid repellent layer 17, after forming a molecular film of metal alkoxide containing fluorine, the layer may be formed through the drying process, the annealing process or the like.

Thereafter, in the cutting process, after bonding the dicing tape onto the first surface 100*a* or the second surface 100*b* of the substrate 100, the substrate 100 is irradiated with laser along the grooves 12, as shown in FIG. 8H, the individual nozzle plates 1 (individual pieces) are separated, and the nozzle plate 1 is peeled off from the dicing tape, thereby to obtain the nozzle pate 1. As a result, the nozzle plate 1 having the end surfaces 101 and 102 including the first end surfaces 101*a* and 102*a*, the second end surfaces 101*b* and 102*b* and the third end surfaces 101*c* and 102*c* is formed, and such a nozzle plate 1 has a structure in which the liquid-resistant protective layer 16 and the liquid repellent layer 17 are continuously formed from the liquid droplet discharge surface 1*a* to the second end surfaces 101*b* and 102*b*.

In order to manufacture the liquid droplet discharge head 10 using the nozzle plate 1 manufactured in this manner, as described referring to FIGS. 3 and 4, the flow path substrate 23, the common liquid chamber substrate 24, the compliance substrate 25, the unit case 26 or the like overlap the nozzle plate 1, thereby to constitute the liquid droplet discharge head 10. The liquid droplet discharge head 10 configured in this manner is attached to the carriage 3 shown in FIG. 1 as the head assembly 110 so that the row direction of the nozzle holes 11 is matched with the auxiliary scanning direction.

Embodiment 2

Figure 9A:
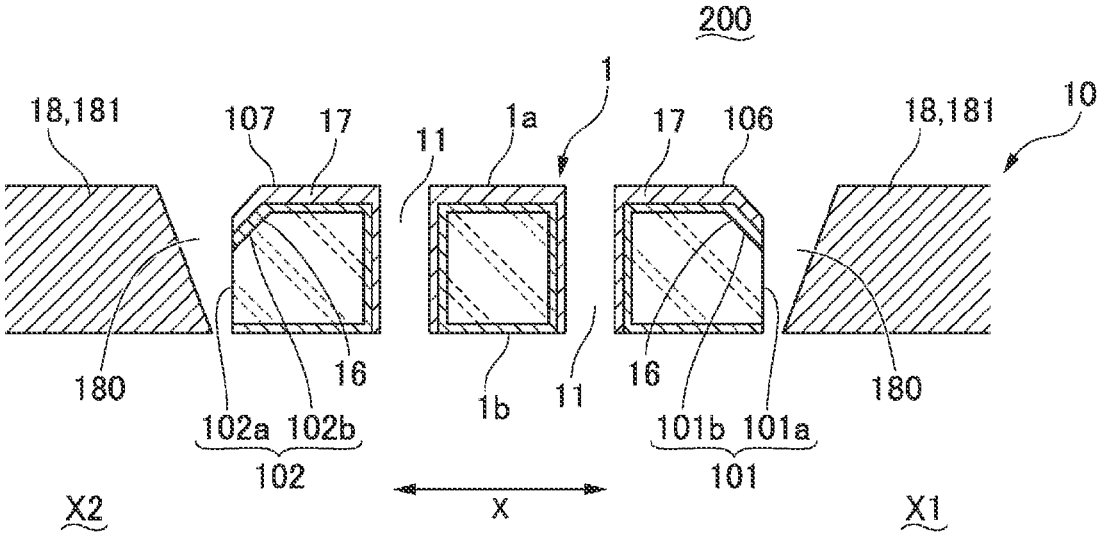
FIGS. 9A and 9B are explanatory views of a nozzle plate of the liquid droplet discharge head of a liquid droplet discharge device related to Embodiment 2 of the invention.
Figure 9B:
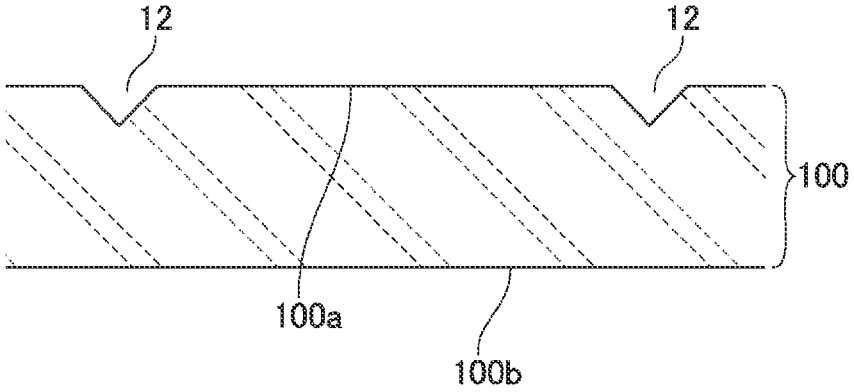

FIGS. 9A and 9B are explanatory views of the nozzle plate 1 of the liquid droplet discharge head 10 of the liquid droplet discharge device 200 related to Embodiment 2 of the invention, enlarged cross-sectional views showing an aspect in which the nozzle plate 1 of the liquid droplet discharge head 10 and the periphery thereof are cut in the main scanning direction X, and explanatory views showing an aspect in which the substrate 100 is formed with the grooves 12. In addition, since basic configurations of the present embodiment are the same as those of Embodiment 1, the common portions are denoted by the same reference numerals, and the descriptions thereof will be omitted. Furthermore, in FIGS. 9A and 9B, the liquid droplet discharge surface 1*a* of both surfaces of the nozzle plate 1 is shown upward.

As shown in FIG. 9A, in the liquid droplet discharge head 10 of the liquid droplet discharge device 200 of the present embodiment, as in Embodiment 1, the nozzle plate 1 is also formed with the liquid-resistant protective layer 16 on the liquid droplet discharge surface 1*a* and the back surface 1*b*, and the liquid-resistant protective layer 16 is also formed on the inner surface of the nozzle holes 11. Furthermore, in the nozzle plate 1, the liquid repellent layer 17 is formed on the liquid droplet discharge surface 1*a*, and the liquid repellent layer 17 is also formed on the inner surface of the nozzle holes 11.

In the present embodiment, in the end portions 106 and 107 of the nozzle plate 1, the corner of the liquid droplet discharge surface 1*a* side has an obliquely chamfered shape. For this reason, the first end surface 101*a* connected to the back surface 1*b* at a right angle, and the second end surface 101*b* constituted by an inclined surface facing the liquid droplet discharge side between the first end surface 101*a* and the liquid droplet discharge surface 1*a* on the inner side of the first end surface 101*a* are formed on the end surface 101. Furthermore, like the end surface 101, the first end surface 102*a* connected to the back surface 1*b* at a right angle, and the second end surface 102*b* constituted by an inclined surface facing the liquid droplet discharge side between the first end surface 102*a* and the liquid droplet discharge surface 1*a* on the inner side of the second end surface 102*a* are formed on the end surface 102.

Furthermore, on the second end surfaces 101*b* and 102*b*, the liquid-resistant protective layer 16 and the liquid repellent layer 17 are continuously formed over the boundary between the liquid droplet discharge surface 1*a* and the end surfaces 101 and 102 from the liquid droplet discharge surface 1*a*. However, the liquid-resistant protective layer 16 and the liquid repellent layer 17 are not formed on the first end surfaces 101*a* and 102*a*, and the boundary between the portion coated with the liquid repellent layer 17 and the non-coated portion in the end surface 101 is located at a position that is closer to the liquid droplet discharge surface 1*a* than the back surface 1*b* of the liquid droplet discharge surface 1*a*.

Furthermore, in the present embodiment, as in Embodiment 1, the bottom plate portion 181 of the fixing plate 18 also does not overlap the nozzle plate 1 in the end portions 106 and 107.

In this manner, in the liquid droplet discharge head 10 of the present embodiment, as in Embodiment 1, the liquid repellent layer 17 is also continuously formed from the liquid droplet discharge surface 1*a* to the middle position in the thickness direction of the end surfaces 101 and 102 of the nozzle plate 1. For this reason, when the wiping member 4 shown in FIG. 1 comes into contact with the nozzle plate 1, the wiping member 4 does not come into contact with the edge of the liquid repellent layer 17. Therefore, even in the end portions 106 and 107 of the nozzle plate 1 located at the initial point side of wiping using the wiping member 4, since there is no need for a structure in which the liquid droplet discharge surface 1*a* of the nozzle plate 1 overlaps the fixing plate 18, the size of the nozzle plate 1 can be reduced. Thus, the costs of the nozzle plate 1 can be reduced.

The nozzle plate 1 having such a configuration can be realized, by forming the grooves 12 having a cross-section of a V shape shown in FIG. 9B, by the use of the wet etching, the dry etching of concurrently etching the etching mask 51, the combination of the wet etching and the dry etching or the like, when forming the grooves 12 in the groove forming process described referring to FIGS. 7A and 7B.

Embodiment 3

Figure 10A:
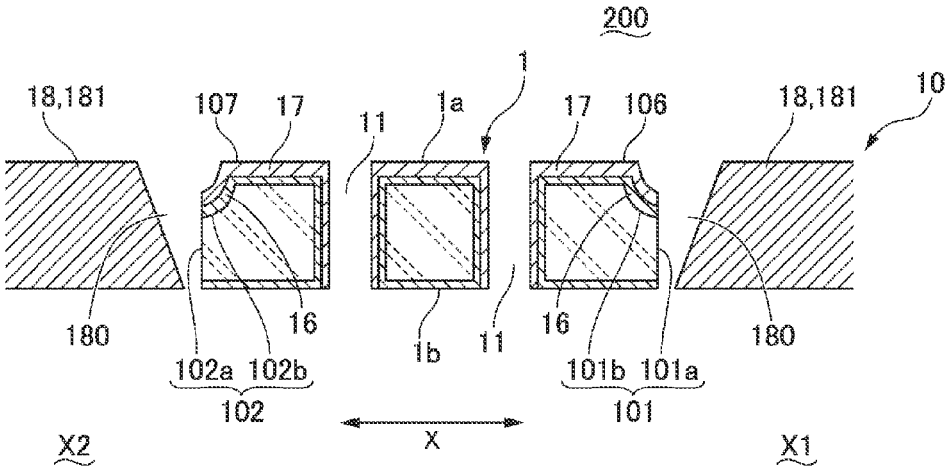
FIGS. 10A and 10B are explanatory views of a nozzle plate of the liquid droplet discharge head of a liquid droplet discharge device related to Embodiment 3 of the invention.
Figure 10B:
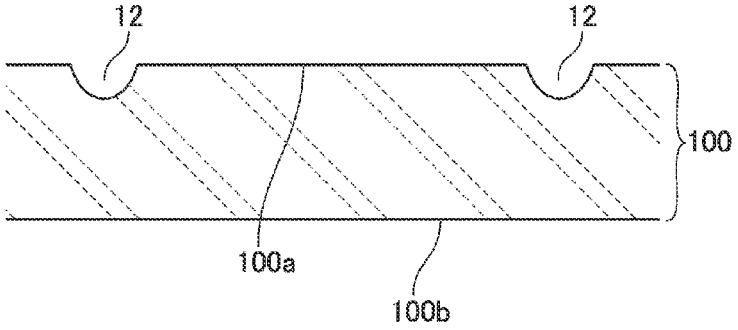

FIGS. 10A and 10B are explanatory views of the nozzle plate 1 of the liquid droplet discharge head 10 of the liquid droplet discharge device 200 related to Embodiment 3 of the invention, enlarged cross-sectional views showing an aspect in which the nozzle plate 1 of the liquid droplet discharge head 10 and the periphery thereof are cut in the main scanning direction X, and explanatory views showing an aspect in which the substrate 100 is formed with the grooves 12. In addition, since basic configurations of the present embodiment are those of the same as Embodiment 1, the common portions are denoted by the same reference numerals, and the descriptions thereof will be omitted. Furthermore, in FIGS. 10A and 10B, the liquid droplet discharge surface 1*a* of both surfaces of the nozzle plate 1 is shown upward.

As shown in FIG. 10A, in the liquid droplet discharge head 10 of the liquid droplet discharge device 200 of the present embodiment, as in Embodiment 1, the nozzle plate 1 is also formed with the liquid-resistant protective layer 16 on the liquid droplet discharge surface 1*a* and the back surface 1*b*, and the liquid-resistant protective layer 16 is also formed on the inner surface of the nozzle holes 11. Furthermore, in the nozzle plate 1, the liquid repellent layer 17 is formed on the liquid droplet discharge surface 1*a*, and the liquid repellent layer 17 is also formed on the inner surface of the nozzle holes 11.

In the present embodiment, in the end portions 106 and 107 of the nozzle plate 1, the corner of the liquid droplet discharge surface 1*a* side has a concavely curved notched shape. For this reason, the first end surface 101*a* connected to the back surface 1*b* at a right angle, and the second end surface 101*b* constituted by an concaved curved surface facing the liquid droplet discharge side between the first end surface 101*a* and the liquid droplet discharge surface 1*a* on the inner side of the first end surface 101*a* are formed on the end surface 101. Furthermore, like the end surface 101, the first end surface 102*a* connected to the back surface 1*b* at a right angle, and the second end surface 102*b* constituted by a concaved curved surface facing the liquid droplet discharge side between the first end surface 102*a* and the liquid droplet discharge surface 1*a* on the inner side of the second end surface 102*a* are also formed on the end surface 102. Furthermore, the liquid-resistant protective layer 16 and the liquid repellent layer 17 are continuously formed from the liquid droplet discharge surface 1*a* on the second end surfaces 101*b* and 102*b*. However, the liquid-resistant protective layer 16 and the liquid repellent layer 17 are not formed on the first end surfaces 101*a* and 102*a*.

Furthermore, in the present embodiment, as in Embodiment 1, the bottom plate portion 181 of the fixing plate 18 also does not overlap the nozzle plate 1 in the end portions 106 and 107.

In this manner, in the present embodiment, as in Embodiment 1, the liquid repellent layer 17 is also continuously formed from the liquid droplet discharge surface 1*a* to the middle position in the thickness direction of the end surfaces 101 and 102 of the nozzle plate 1. For this reason, when the wiping member 4 shown in FIG. 1 comes into contact with the nozzle plate 1, the wiping member 4 does not come into contact with the edge of the liquid repellent layer 17. Therefore, even in the end portions 106 and 107 of the nozzle plate 1 located at the initial point side of wiping using the wiping member 4, since there is no need for a structure in which the liquid droplet discharge surface 1*a* of the nozzle plate 1 overlaps the fixing plate 18, the size of the nozzle plate 1 can be reduced. Thus, the costs of the nozzle plate 1 can be reduced.

The nozzle plate 1 having such a configuration can be realized by forming the grooves 12 having a cross-section of a U shape shown in FIG. 10B by the use of the wet etching or the combination of the wet etching and the dry etching or the like, when forming the grooves 12 in the groove forming process described referring to FIGS. 7A and 7B.

Embodiment 4

Configuration of Nozzle Plate 1 or the Like

Figure 11:
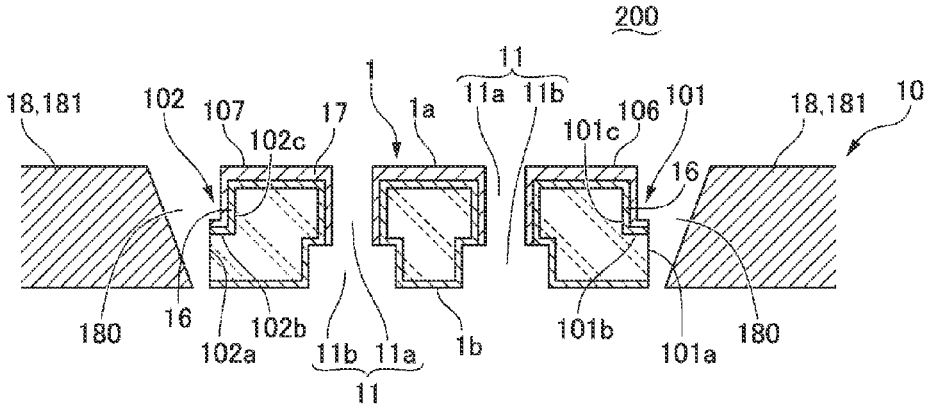
FIG. 11 is an enlarged cross-sectional view that shows an aspect in which a nozzle plate of a liquid droplet discharge head of a liquid droplet discharge device related to Embodiment 4 of the invention and a periphery thereof are cut in a main scanning direction.

FIG. 11 is an enlarged cross-sectional view that shows an aspect in which a nozzle plate 1 of the liquid droplet discharge head 10 of the liquid droplet discharge device 200 related to Embodiment 4 of the invention and a periphery thereof are cut in a main scanning direction X. In addition, since basic configurations of the present embodiment are the same as those of Embodiment 1, the common portions are denoted by the same reference numerals, and the descriptions thereof will be omitted. Furthermore, in FIG. 11, the liquid droplet discharge surface 1*a* of both surfaces of the nozzle plate 1 is shown upward.

In Embodiment 1, although the nozzle holes 11 have the approximately same internal radius and penetrate through the nozzle plate 1, in the present embodiment, as shown in FIG. 11, the nozzle holes 11 have nozzle portions formed in a cylindrical shape of two stages having different diameters. More specifically, the nozzle holes 11 include a small-diameter first nozzle portion (a small-diameter hole of an injection port portion) 11*a*, a leading end of which is opened to the liquid droplet discharge surface 1*a*, and a large-diameter second nozzle portion (a large-diameter hole of an introduction hole portion) 11*b* that communicates with the first nozzle portion 11*a* on the back surface 1*b* side and is opened to the back surface 1*b*. The first nozzle portion and the second nozzle portion 11*b* are provided perpendicularly with respect to the substrate surface, and are coaxially formed. For this reason, since the discharge direction of the ink droplet can be arranged in the central axis direction of the nozzle holes 11, the stable ink discharge characteristics are exhibited. In the present embodiment, for example, the internal diameter of the first nozzle portion 11*a* is 15 to 30 μm, and the internal diameter of the second nozzle portion 11*b* is an approximately 1.5 times the internal diameter of the first nozzle portion 11*a*.

In the nozzle plate 1 having such a configuration, as in Embodiment 1, the nozzle plate 1 is also formed with the liquid-resistant protective layer 16 on the liquid droplet discharge surface 1*a* and the back surface 1*b*, and the liquid-resistant protective layer 16 is also formed on the inner surface of the nozzle holes 11. Furthermore, in the nozzle plate 1, the liquid repellent layer 17 is formed on the liquid droplet discharge surface 1*a*, and the liquid repellent layer 17 is also formed on the inner surface of the nozzle holes 11.

In the present embodiment, the same stage portion as that of Embodiment 1 is formed on the end surfaces 101 and 102 of the nozzle plate 1. For this reason, the first end surface 101*a* connected to the back surface 1*b* at a right angle, and the second end surface 101*b* facing the liquid droplet discharge side between the first end surface 101*a* and the liquid droplet discharge surface 1*a* on the inner side of the first end surface 101*a* are formed on the end surface 101 of the nozzle plate 1. Furthermore, the second end surface 101*b* is formed to be parallel to the liquid droplet discharge surface 1*a*, and the third end surface 101*c* perpendicular to the liquid droplet discharge surface 1*a*, the second end surface 101*b*, and the back surface 1*b* is formed between the liquid droplet discharge surface 1*a* and the second end surface 101*b*. Furthermore, like the end surface 101, the end surface 102 of the nozzle plate 1 is also formed with the first end surface 102*a* connected to the back surface 1*b* of an opposite side at a right angle, and the second end surface 102*b* facing the liquid droplet discharge side between the first end surface 102*a* and the liquid droplet discharge surface 1*a* on the inner side of the first end surface 102*a* are formed. Furthermore, the second end surface 102*b* is formed to be parallel to the liquid droplet discharge surface 1*a*, and the third end surface 102*c* perpendicular to the liquid droplet discharge surface 1*a*, the second end surface 102*b*, and the back surface 1*b* is formed between the liquid droplet discharge surface 1*a* and the second end surface 102*b*. Herein, on the second end surfaces 101*b* and 102*b* and the third end surfaces 101*c* and 102*c*, the liquid-resistant protective layer 16 and the liquid repellent layer 17 are continuously formed over the boundary between the liquid droplet discharge surface 1*a* and the end surfaces 101 and 102 from the liquid droplet discharge surface 1*a*, and the third end surfaces 101*c* and 102*c*. However, the liquid-resistant protective layer 16 and the liquid repellent layer 17 are not formed on the first end surfaces 101*a* and 102*a*. Herein, the boundary between the portion coated with the liquid repellent layer 17 and the non-coated portion is located at an approximately central position between the back surface 1*b* of the liquid droplet discharge surface 1*a* and the liquid droplet discharge surface 1*a*. However, on the end surfaces 101 and 102, it is preferable that the boundary between the portion coated with the liquid repellent layer 17 and the non-coated portion be located at a location that is closer to the liquid droplet discharge surface 1*a* than the back surface 1*b* of the liquid droplet discharge surface 1*a*. According to such a configuration, there is an advantage in that the first concave portions 13*a* and the grooves 12 for forming the nozzle portion described below may be shallowly formed.

Furthermore, in the present embodiment, as in Embodiment 1, the bottom plate portion 181 of the fixing plate 18 also does not overlap the nozzle plate 1 in the end portions 106 and 107.

In this manner, in the present embodiment, as in Embodiment 1, the liquid repellent layer 17 is also continuously formed from the liquid droplet discharge surface 1*a* to the middle position in the thickness direction of the end surfaces 101 and 102 of the nozzle plate 1. For this reason, when the wiping member 4 shown in FIG. 1 comes into contact with the nozzle plate 1, the wiping member 4 does not come into contact with the edge of the liquid repellent layer 17. Therefore, even in the end portions 106 and 107 of the nozzle plate 1 located at the initial point side of wiping using the wiping member 4, since there is no need for a structure in which the liquid droplet discharge surface 1*a* of the nozzle plate 1 overlaps the fixing plate 18, the size of the nozzle plate 1 can be reduced. Thus, the costs of the nozzle plate 1 can be reduced. In addition, in the present embodiment, although the nozzle hole 11 had a multistage structure based on Embodiment 1, the nozzle plate 11 may have a multistage structure based on Embodiments 2 and 3.

Method of Manufacturing Nozzle Plate 1

Figure 12A:
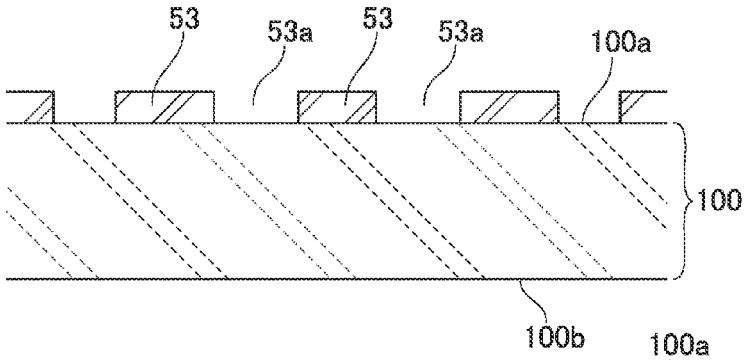
FIGS. 12A to 12D are process cross-sectional views that show a method of manufacturing the nozzle plate shown in FIG. 11.
Figure 12B:
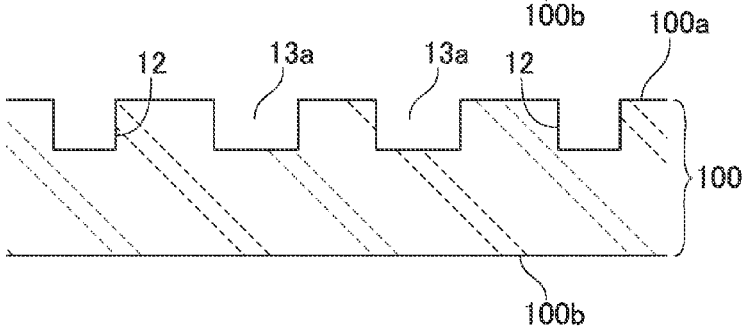
Figure 13E:
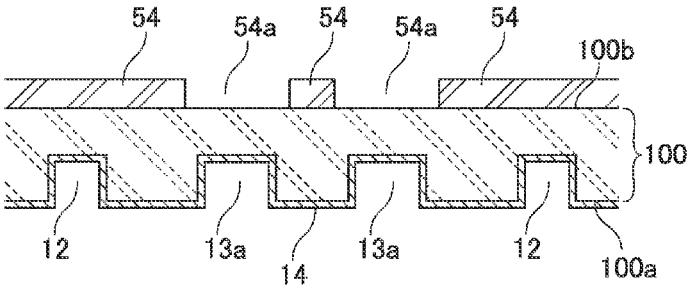
FIGS. 13E to 13G are process cross-sectional views that show the method of manufacturing the nozzle plate performed subsequent to FIGS. 12A to 12D.
Figure 13F:
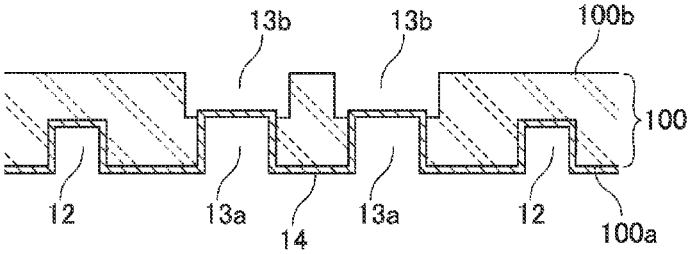
Figure 13G:
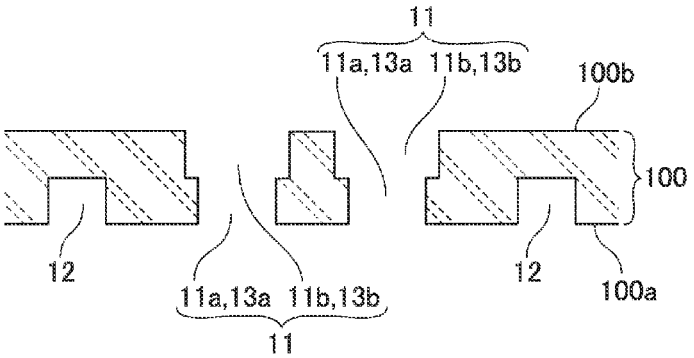
Figure 14H:
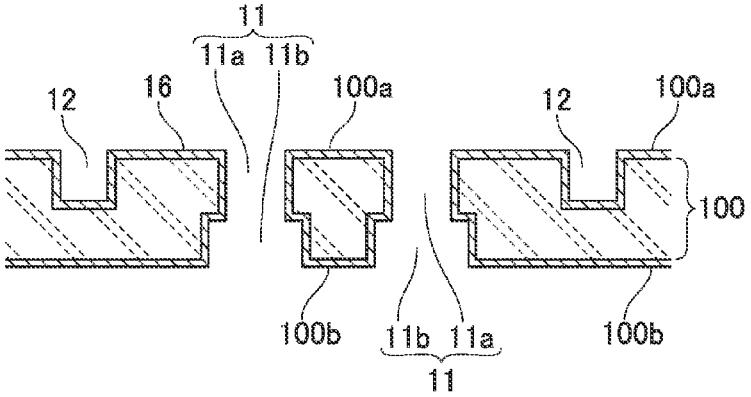
FIGS. 14H to 14J are process cross-sectional views that show the method of manufacturing the nozzle plate performed subsequent to FIGS. 13E to 13G.
Figure 14I:
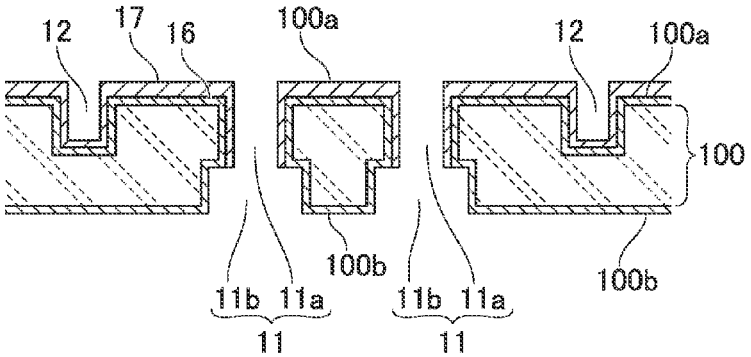
Figure 14J:
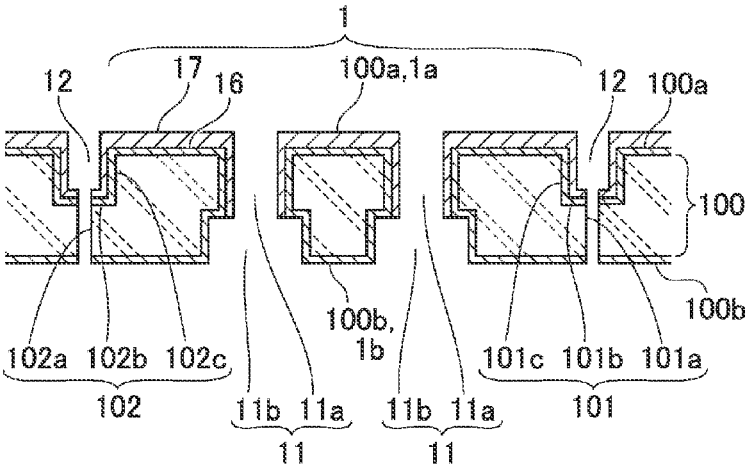

An example of a method of manufacturing the nozzle plate shown in FIG. 11 will be described referring to FIGS. 12A to 14J. FIGS. 12A to 12D are process cross-sectional views that show the method of manufacturing the nozzle plate 1 shown in FIG. 11. FIGS. 13E to 13G are process cross-sectional views that show the method of manufacturing the nozzle plate 1 performed subsequent to FIGS. 12A to 12D. FIGS. 14H to 14J are process cross-sectional views that show the method of manufacturing the nozzle plate 1 performed subsequent to FIGS. 13E to 13G. In addition, in FIGS. 12A to 12D and 14H to 14J, in the first surface 100*a* and the second surface 100*b* of the substrate 100, the side serving as the liquid droplet discharge surface 1*a* when forming the nozzle plate 1 is shown upward. In FIGS. 13E to 13G, in the first surface 100*a* and the second surface 100*b* of the substrate 100, the side serving as the liquid droplet discharge surface 1*a* when forming the nozzle plate 1 is shown downward.

In the present embodiment, an example of a manufacturing method of forming the grooves 12 by the use of a part of the processes of forming the nozzle holes 11 will be described. More specifically, first, in the first concave portion forming process (the nozzle hole forming process) shown in FIGS. 12A and 12B, the first surface 100*a* of the substrate 100 is etched in the state of forming the first etching mask 53 on the first surface 100*a* of the substrate 100, the first concave portions 13*a* for forming the first nozzle portion are formed, and the grooves 12 are formed. More specifically, as shown in FIG. 12A, the etching mask 53 formed of a resist mask is formed by the use of the photolithography technique. Next, the first surface 100*a* of the substrate 100 is etched via the opening hole portion 53*a* of the etching mask 53, as shown in FIG. 12B, the first groove portions 13*a* and the grooves 12 for forming the first nozzle portion are concurrently formed, and then the etching mask 53 is removed by the sulfuric acid treatment or the like. As such etching, in the present embodiment, the first surface 100*a* of the substrate 100 is subjected to the anisotropic dry etching by the use of an ICP dry etching device (not shown), and the first concave portions 13*a* and the grooves 12 are formed perpendicularly with respect to the first surface 100*a*. As the etching as of this case, $C_4F_8$ gas and $SF_6$ gas are used, and such etching gases are alternately used.

Figure 12C:
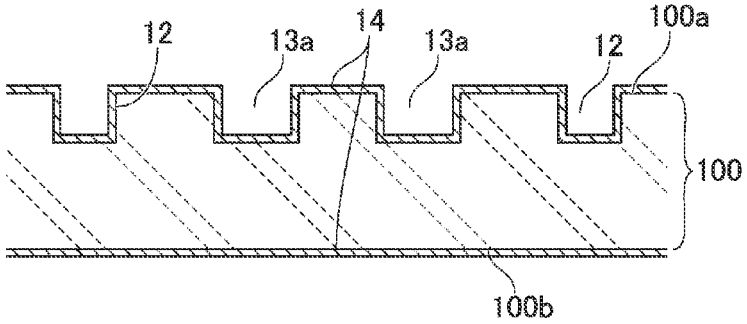

Next, as shown in FIG. 12C, the protective film 14 is formed on the entire surface of the substrate 100. More specifically, the substrate 100 is set on a thermal oxidation device (not shown), the substrate 100 is subjected to the thermal oxidation treatment under the condition of the mixed atmosphere of oxygen and vapor at an oxidation temperature of 1075° C. and an oxidation time of 4 hours, and the protective film 14 formed of a $SiO_2$ film having a film thickness of 1 μm is formed on the entire surface of the substrate 100.

Figure 12D:
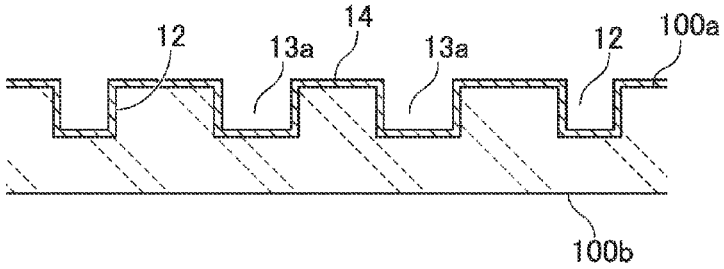

Next, in the thinning process shown in FIG. 12D, the substrate 100 is thinned from the second surface 100*b* side of the substrate 100. When performing the thinning process, in the present embodiment, after performing the grinding work or the polishing work on the second surface 100*b* side of the substrate 100, cleaning is performed. Further, in the thinning process, the substrate 100 may be thinned by etching.

Next, in the second concave portion forming process (the nozzle hole forming process) shown in FIGS. 13E and 13F, the substrate 100 is etched in the state of forming the etching mask 54 on the second surface 100*b* of the substrate 100, and second concave portions 13*b* for forming the second nozzle portion having a diameter greater than that of the first concave portions 13*a* is formed in a region overlapping the first concave portion 13*a* when viewed from a plane. More specifically, as shown in FIG. 13E, an etching mask 54 formed of a resist mask is formed on the second surface 100*b* of the substrate 100, by the use of the photolithography technique. Next, the second surface 100*b* of the substrate 100 is etched via the opening hole portion 54*a* of the etching mask 54, as shown in FIG. 13F, the second concave portions 13*b* for forming the second nozzle portion is formed, and then the etching mask 54 is removed by the sulfuric acid treatment or the like. As such etching, in the present embodiment, like the first concave portion forming process, the second surface 100*b* of the substrate 100 is subjected to the anisotropic dry etching by the use of an ICP dry etching device (not shown), and the second concave portions 13*b* are formed perpendicularly with respect to the second surface 100*b*. As the etching as of this case, $C_4F_8$ gas and $SF_6$ gas are used, and such etching gases are alternately used.

Next, as shown in FIG. 13G, the protective film 14 is subjected to the wet etching by the use of hydrofluoric acid solution or the like, thereby to remove the protective film 14. As a result, the substrate 100 is formed with the nozzle holes 11 through which a small-diameter first nozzle portion 11*a* communicates with a large-diameter second nozzle portion 11*b*.

Next, in the liquid-resistant protective layer forming process shown in FIG. 14H, the liquid-resistant protective layer 16 having ink-resistant properties is formed on the entire surface of the substrate 100 including the inner wall of the nozzle holes 11. In the present embodiment, the substrate 100 is input to a thermal oxidation furnace, and a thermal oxidation film ($SiO_2$ film), for example, having a film thickness of 0.1 μm is formed on the entire surface of the substrate 100 as the liquid-resistant protective layer 16.

Next, in the liquid repellent coating process shown in FIG. 14I, the liquid repellent material including a silicon compound containing the fluorine atoms as a main ingredient is formed on the first surface 100*a* of the substrate 100 by the method such as a vapor deposition, and the liquid repellent layer 17 is formed on the entire first surface 100*a* of the substrate 100. At this time, the liquid repellent layer 17 is also formed on the inner wall of the nozzle holes 11.

Thereafter, in the cutting process, after bonding the dicing tape onto the first surface 100*a* or the second surface 100*b* of the substrate 100, the substrate 100 is irradiated with laser along the grooves 12, as shown in FIG. 14J, the individual nozzle plates 1 are separated, and the nozzle plate 1 is peeled off from the dicing tape, thereby to obtain the nozzle pate 1. As a result, the nozzle plate 1 having the end surfaces 101 and 102 including the first end surfaces 101*a* and 102*a*, the second end surfaces 101*b* and 102*b* and the third end surfaces 101*c* and 102*c* is formed, and such a nozzle plate 1 has a structure in which the liquid-resistant protective layer 16 and the liquid repellent layer 17 are continuously formed from the liquid droplet discharge surface 1*a* to the second end surfaces 101*b* and 102*b*.

Other Embodiment

In the above-mentioned embodiment, although the bottom plate portion 181 of the fixing plate 18 does not overlap the liquid droplet discharge surface 1*a* in all of the end portions of the nozzle plate 1, it may be adopt a configuration in which, when fixing the liquid droplet discharge head 10 by the fixing plate 18, the bottom plate portion 181 of the fixing plate 18 overlaps the liquid droplet discharge surface 1*a* in the end portions other than the end portions 106 and 107 of the nozzle plate 1. In such a configuration, since the end portions other than the end portions 106 and 107 of the nozzle plate 1 also correspond to the short side, the size of the nozzle plate 1 remains small. Therefore, like a configuration in which the bottom plate portion 181 of the fixing plate 18 does not overlap the liquid droplet discharge surface 1*a* in all of the end portions of the nozzle plate 1, the costs of the nozzle plate 1 can be reduced.

In the above-mentioned embodiment, in the processes shown in FIGS. 7A to 7D, although the concave portions 13 and the grooves 12 for forming the nozzle hole are formed by the different etching processes, as in Embodiment 4, the grooves 12 may be formed by the use of the etching process of the groove portions 13 for forming the nozzle hole.

Although the liquid droplet discharge head 10 of the liquid droplet discharge device 200 used for the piezoelectric element has been described in the above-mentioned embodiment, the invention is not limited to the above-mentioned embodiments, but can be variously changed within the scope of the technical idea of the invention. The invention may be applied to the liquid droplet discharge head 10 that uses electrostatic force for a driving unit, a heater element or the like, as driving unit. Furthermore, the invention can be applied to a liquid droplet discharge device other than an ink jet printer, by changing the liquid material discharged from the nozzle holes 11.

The entire disclosure of Japanese Patent Application No. 2012-094516, filed Apr. 18, 2012 is expressly incorporated by reference herein.

What is claimed is:

1. A liquid droplet discharge device comprising:

a liquid droplet discharge head in which a liquid repellent layer is formed over a liquid droplet discharge surface of a nozzle plate, the liquid repellant layer including a liquid repellant layer portion and a liquid resistant protective layer portion, the liquid repellent layer portion being disposed on the liquid-resistant protective layer portion, the nozzle plate defining a nozzle opening;

a fixing plate that fixes the liquid droplet discharge head to a head supporter; and a wiping member that wipes the liquid droplet discharge surface by a relative movement with the liquid droplet discharge head, wherein the nozzle plate includes an end surface that is adjacent to the fixing plate, the end surface including a coated portion and a non-coated portion, the coated portion being coated by the liquid repellent layer that is continuously coated from the liquid droplet discharge surface to the coated portion, the non-coated portion being not coated by the liquid repellent layer, and the fixing plate does not overlap the liquid droplet discharge surface and fixes the liquid droplet discharge head to the head supporter at an initial point side of wiping using the wiping member.

2. The liquid droplet discharge device according to claim 1, wherein a boundary between the coated portion and the non-coated portion is closer to the liquid droplet discharge surface than a back surface of the nozzle plate.

3. The liquid droplet discharge device according to claim 2, wherein the end surface includes a first end surface connected to the back surface of the liquid droplet discharge surface, and a second end surface connected to the first end surface and parallel to the liquid droplet discharge surface, and the liquid repellent layer is continuously coated from the liquid droplet discharge surface to the second end surface, the first end surface comprising the non-coated portion of the end surface.

4. The liquid droplet discharge device according to claim 3, wherein the second end surface extends along a surface parallel to the liquid droplet discharge surface, and the end surface includes a third end surface that is connected to the liquid droplet discharge surface and the second end surface between the liquid droplet discharge surface and the second end surface.

5. The liquid droplet discharge device according to claim 3, wherein the second end surface includes an inclined surface that is inclined with respect to both the liquid droplet discharge surface and the first end surface.

6. The liquid droplet discharge device according to claim 3, wherein the second end surface includes a concave-shaped curved surface.

7. A liquid droplet discharge device that has a nozzle plate in which a liquid repellent layer is formed over a liquid droplet discharge surface, the liquid repellent layer including a liquid repellant layer portion and a liquid-resistant protective layer portion, the liquid repellant layer portion being disposed on the liquid-resistant protective layer portion, the nozzle plate defining a nozzle opening, wherein the liquid repellent layer is also formed in at least a portion of an end portion of the nozzle plate, and the liquid repellent layer formed over the liquid droplet discharge surface continues with the liquid repellent layer formed in the at least a portion of the end portion.

8. The liquid droplet discharge device according to claim 7, wherein the end portion includes a first end surface connected to a back surface of the nozzle plate, and a second end surface connected to the first end surface and parallel to the liquid droplet discharge surface, and the liquid repellent layer is formed over the liquid droplet discharge surface and the second end surface, the second end surface comprising the at least portion of the end portion having the liquid repellent layer portion.

9. The liquid droplet discharge device according to claim 8, wherein the second end surface includes a surface that intersects with both the liquid droplet discharge surface and the first end surface.

10. The liquid droplet discharge device according to claim 8, wherein the second end surface includes a curved surface.

11. The liquid droplet discharge device according to claim 7, wherein the end portion includes a first end surface connected to the back surface of the liquid droplet discharge surface, a second end surface connected to the first end surface, and a third end surface connected to the second end surface and the liquid droplet discharge surface, the second end surface is parallel to the liquid droplet discharge surface, and the liquid repellent layer is formed over the liquid droplet discharge surface, the second end surface, and the third end surface, the second and third end surfaces comprising the at least portion of the end portion having the liquid repellent layer.

* * * * *